US009347675B2

(12) United States Patent
Breshears

(10) Patent No.: US 9,347,675 B2
(45) Date of Patent: May 24, 2016

(54) ARCHITECTURAL HEAT AND MOISTURE EXCHANGE

(71) Applicant: Architectural Applications P.C., Portland, OR (US)

(72) Inventor: John Edward Breshears, Portland, OR (US)

(73) Assignee: Architectural Applications P.C., Portland, OR (US)

( * ) Notice: Subject to any disclaimer, the term of this patent is extended or adjusted under 35 U.S.C. 154(b) by 0 days.

(21) Appl. No.: 14/518,451

(22) Filed: Oct. 20, 2014

(65) Prior Publication Data

US 2015/0034283 A1 Feb. 5, 2015

Related U.S. Application Data

(63) Continuation of application No. 13/185,435, filed on Jul. 18, 2011.

(51) Int. Cl.

| | |
|---|---|
| ***F24F 3/147*** | (2006.01) |
| ***F24F 12/00*** | (2006.01) |
| ***F28D 21/00*** | (2006.01) |
| *F24F 3/14* | (2006.01) |

(52) U.S. Cl.

CPC ..... *F24F 3/147* (2013.01); *F24F 12/006* (2013.01); *F28D 21/0015* (2013.01); *F24F 2003/1435* (2013.01)

(58) Field of Classification Search

CPC ..... F24J 2/202; F24J 2/0444; F24F 3/147; F24F 2003/1435; F24F 12/006; F24D 21/0015

USPC ..... 126/702, 650; 96/4, 52; 165/54, 53

See application file for complete search history.

(56) References Cited

U.S. PATENT DOCUMENTS

| | | | |
|---|---|---|---|
| 246,626 | A | 9/1881 | Morse |
| 549,765 | A | 11/1895 | Calver |
| 2,288,465 | A | 6/1942 | Knudsen |
| 2,595,905 | A | 5/1952 | Telkes |
| 3,666,007 | A | 5/1972 | Yoshino et al. |
| 3,720,025 | A | 3/1973 | Eichman |

(Continued)

FOREIGN PATENT DOCUMENTS

| | | | |
|---|---|---|---|
| CA | 1113789 | A1 | 12/1981 |
| EP | 0661502 | A2 | 7/1995 |

(Continued)

OTHER PUBLICATIONS

Nov. 26, 2014, Office action from US Patent and Trademark Office, in U.S. Appl. No. 13/185,439, which is another application of John E. Breshears.

(Continued)

*Primary Examiner* — Avinash Savani
*Assistant Examiner* — Deepak Deean
(74) *Attorney, Agent, or Firm* — Kolisch Hartwell, P.C.

(57) ABSTRACT

An architectural heat and moisture exchanger. The exchanger defines an interior channel which is divided into a plurality of sub-channels by a membrane configured to allow passage of water vapor and to prevent substantial passage of air. In some embodiments, the exchanger includes an opaque housing configured to form a portion of a building enclosure, such as an exterior wall, an interior wall, a roof, a floor, or a foundation.

20 Claims, 17 Drawing Sheets

(56) References Cited

U.S. PATENT DOCUMENTS

| | | | | |
|---|---|---|---|---|
| 3,785,931 | A | 1/1974 | Coffey et al. | |
| 3,860,055 | A | 1/1975 | Wild | |
| 3,866,672 | A * | 2/1975 | Rich et al. | 165/50 |
| 3,923,461 | A | 12/1975 | Barden | |
| 3,925,212 | A | 12/1975 | Tchernev | |
| 3,925,945 | A | 12/1975 | White | |
| 3,926,561 | A | 12/1975 | Lucero | |
| 3,955,555 | A | 5/1976 | Boström | |
| 3,977,466 | A | 8/1976 | Johansson | |
| 3,981,294 | A | 9/1976 | Deminet et al. | |
| 4,019,868 | A | 4/1977 | Sebacher et al. | |
| 4,031,680 | A * | 6/1977 | Stoakes | 52/204.597 |
| 4,040,804 | A | 8/1977 | Harrison | |
| 4,050,443 | A | 9/1977 | Peck et al. | |
| 4,068,652 | A | 1/1978 | Worthington | |
| 4,159,707 | A | 7/1979 | Miquel | |
| 4,173,253 | A | 11/1979 | Wiegand | |
| 4,182,406 | A | 1/1980 | Holbrook et al. | |
| 4,183,398 | A | 1/1980 | Ehrke | |
| 4,232,731 | A | 11/1980 | Kaplow et al. | |
| 4,259,401 | A | 3/1981 | Chahroudi et al. | |
| 4,269,171 | A | 5/1981 | McArthur | |
| 4,270,516 | A | 6/1981 | Hopper et al. | |
| 4,285,332 | A | 8/1981 | McHugh | |
| 4,301,787 | A | 11/1981 | Rice | |
| 4,331,066 | A | 5/1982 | Schmidlin | |
| 4,338,996 | A | 7/1982 | Frank | |
| 4,369,765 | A | 1/1983 | McDaniel | |
| 4,382,436 | A | 5/1983 | Hager | |
| 4,393,861 | A | 7/1983 | Beard et al. | |
| 4,393,961 | A | 7/1983 | Boon | |
| 4,412,528 | A | 11/1983 | Elzinga, Jr. | |
| 4,418,378 | A | 11/1983 | Johnson | |
| 4,436,084 | A | 3/1984 | Carlston et al. | |
| 4,469,087 | A | 9/1984 | Cameron | |
| 4,478,210 | A | 10/1984 | Sieradski | |
| 4,577,619 | A | 3/1986 | Howe, Jr. | |
| 4,582,129 | A | 4/1986 | Yano et al. | |
| 4,609,039 | A | 9/1986 | Fushiki et al. | |
| 4,658,806 | A | 4/1987 | Boozer | |
| 4,691,763 | A | 9/1987 | Kennedy | |
| 4,867,134 | A | 9/1989 | O'Brien | |
| 4,872,503 | A | 10/1989 | Marriner | |
| 4,903,503 | A | 2/1990 | Meckler | |
| 4,913,818 | A | 4/1990 | Van Wijk et al. | |
| 4,932,982 | A | 6/1990 | Hayes | |
| 4,950,314 | A | 8/1990 | Yamada et al. | |
| 5,069,272 | A | 12/1991 | Chagnot | |
| 5,082,173 | A | 1/1992 | Poehlman et al. | |
| 5,181,387 | A | 1/1993 | Meckler | |
| 5,182,921 | A | 2/1993 | Yan | |
| 5,240,480 | A | 8/1993 | Thorogood et al. | |
| 5,551,991 | A | 9/1996 | Avero | |
| 5,569,633 | A | 10/1996 | Carolan et al. | |
| 5,617,913 | A | 4/1997 | DeGregoria et al. | |
| 5,681,368 | A | 10/1997 | Rahimzadeh | |
| 5,733,435 | A | 3/1998 | Prasad et al. | |
| 5,788,748 | A | 8/1998 | Mazanec et al. | |
| 5,855,972 | A | 1/1999 | Kaeding | |
| 5,976,220 | A | 11/1999 | Braun et al. | |
| 6,054,229 | A | 4/2000 | Hsu et al. | |
| 6,059,862 | A | 5/2000 | Mizobe et al. | |
| 6,126,723 | A | 10/2000 | Drost et al. | |
| 6,145,588 | A | 11/2000 | Martin et al. | |
| 6,178,966 | B1 | 1/2001 | Breshears | |
| 6,273,180 | B1 | 8/2001 | Joshi et al. | |
| 6,319,115 | B1 | 11/2001 | Shingaki | |
| 6,361,588 | B1 | 3/2002 | Moratalla | |
| 6,401,428 | B1 | 6/2002 | Glover et al. | |
| 6,413,298 | B1 | 7/2002 | Wnek et al. | |
| 6,635,104 | B2 | 10/2003 | Komkova et al. | |
| 6,866,701 | B2 | 3/2005 | Meirav | |
| 7,013,950 | B2 * | 3/2006 | Steneby et al. | 165/11.1 |
| 7,036,560 | B1 | 5/2006 | Rylewski | |
| 7,604,689 | B2 | 10/2009 | Siverklev | |
| 8,496,732 | B2 | 7/2013 | Culp et al. | |
| 8,500,848 | B2 | 8/2013 | Claridge et al. | |
| 8,641,806 | B2 | 2/2014 | Claridge et al. | |
| 8,685,144 | B2 | 4/2014 | Claridge et al. | |
| 8,685,145 | B2 | 4/2014 | Claridge et al. | |
| 2001/0018962 | A1 | 9/2001 | Joshi et al. | |
| 2002/0104439 | A1 | 8/2002 | Komkova et al. | |
| 2004/0226685 | A1 | 11/2004 | Gagnon et al. | |
| 2005/0072303 | A1 | 4/2005 | Weidenmann | |
| 2007/0125111 | A1 | 6/2007 | Xiao | |
| 2007/0151447 | A1 | 7/2007 | Merkel | |
| 2008/0230206 | A1 | 9/2008 | Lestage et al. | |
| 2008/0283217 | A1 | 11/2008 | Gagnon et al. | |
| 2009/0025710 | A1 | 1/2009 | Hogan | |
| 2011/0146941 | A1 | 6/2011 | Benoit et al. | |
| 2012/0012290 | A1 | 1/2012 | Breshears | |
| 2012/0118145 | A1 | 5/2012 | Claridge et al. | |
| 2012/0118146 | A1 | 5/2012 | Claridge et al. | |
| 2012/0118147 | A1 | 5/2012 | Claridge et al. | |
| 2012/0118155 | A1 | 5/2012 | Claridge et al. | |
| 2013/0020049 | A1 | 1/2013 | Breshears | |
| 2013/0126123 | A1 | 5/2013 | Breshears | |
| 2013/0312929 | A1 | 11/2013 | Breshears | |
| 2014/0034268 | A1 | 2/2014 | Breshears | |

FOREIGN PATENT DOCUMENTS

| | | | |
|---|---|---|---|
| GB | 2081877 | A | 2/1982 |
| JP | 54-145048 | A | 11/1979 |
| JP | 56-30555 | A | 3/1981 |
| JP | 59-1989 | A | 1/1984 |
| JP | 9-318099 | A | 12/1997 |
| WO | 2005090873 | A1 | 9/2005 |
| WO | 2008106973 | A1 | 9/2008 |
| WO | 2013012639 | A1 | 1/2013 |

OTHER PUBLICATIONS

Sep. 27, 2012, International Search Report of the International Searching Authority from the U.S. Receiving Office, in PCT/US2012/046299, which is another application of applicant John E. Breshears.

Sep. 27, 2012, Written Opinion of the International Searching Authority from the U.S. Receiving Office, in PCT/US2012/046299, which is another application of applicant John E. Breshears.

Jul. 16, 2013, Office action from U.S. Patent and Trademark Office, in U.S. Appl. No. 13/747,218, which is another application of applicant John E. Breshears.

Dec. 5, 2013, Office action from U.S. Patent and Trademark Office, in U.S. Appl. No. 13/747,218, which is another application of applicant John E. Breshears.

Dec. 19, 2013, First Action Pilot Program Pre-Interview Communication from U.S. Patent and Trademark Office, in U.S. Appl. No. 13/185,439, which is another application of applicant John E. Breshears.

Jan. 2, 2014, First Action Pilot Program Pre-Interview Communication from U.S. Patent and Trademark Office, in U.S. Appl. No. 13/185,435, which is another application of applicant John E. Breshears.

Jan. 21, 2014, International Preliminary Report on Patentability from the International Bureau of WIPO, in PCT/US2012/046299, which is another application of applicant John E. Breshears.

Apr. 1, 2014, Office action from U.S. Patent and Trademark Office, in U.S. Appl. No. 13/185,439, which is another application of applicant John E. Breshears.

Apr. 1, 2014, Office action from U.S. Patent and Trademark Office, in U.S. Appl. No. 13/185,435, which is another application of applicant John E. Breshears.

Aug. 1, 2014, Office action from U.S. Patent and Trademark Office, in U.S. Appl. No. 13/185,439, which is another application of applicant John E. Breshears.

Aug. 1, 2014, Office action from U.S. Patent and Trademark Office, in U.S. Appl. No. 13/185,435, which is another application of applicant John E. Breshears.

(56) References Cited

OTHER PUBLICATIONS

Kunzel, Hartwig M., Simultaneous Heat and Moisture Transport in Building Components, One- and two-dimensional calculation using simple parameters, Frauhofer Institute of Building Physics, pp. 1-65.
Asaeda et al., "Experimental Studies of Dehumidification of Air by an Improved Ceramic Membrane", Presented at the 50th Annual Meeting of the Society of Chemical Engineers, Yokohama, Japan, Mar. 1985, Journal of Chemical Engineering of Japan, pp. 238-240.
Jan. 30, 2015, Office action from the U.S. Patent and Trademark Office, in U.S. Appl. No. 13/942,376, which is another application of applicant John E. Breshears.
Jul. 9, 2015, First Action Interview Pilot Program Pre-Interview Communication from the U.S. Patent and Trademark Office, in U.S. Appl. No. 14/053,921, which is another application of applicant John E. Breshears.
Sep. 17, 2015, Office action from the U.S. Patent and Trademark Office in U.S. Appl. No. 14/053,921, which is another application of applicant John E. Breshears.
Aug. 6, 2015, Office action from the State Intellectual Property Office of the People'S Republic of China, in Chinese Patent Application No. 201280045105.8, which shares the same priority as this U.S. application.

* cited by examiner

ARCHITECTURAL HEAT AND MOISTURE EXCHANGE

CROSS-REFERENCES

This application is a continuation of U.S. patent application Ser. No. 13/185,435, filed Jul. 18, 2011, which is hereby incorporated by reference in its entirety. This application also incorporates by reference in its entirety for all purposes the following: U.S. Pat. No. 6,178,966, issued Jan. 30, 2001 and U.S. Patent Publication No. 2007/0151447 to Merkel, published Jul. 5, 2007.

INTRODUCTION

In centrally heated or cooled buildings, fresh air or "makeup air" is typically added continuously to the total volume of circulated air, resulting in some previously heated or cooled air being exhausted from the building space. This can result in an undesirable loss of energy and humidity from the building. Heat exchangers are commonly used in the exhaust air and makeup airflow paths of these systems to recover some of the energy from the exhaust air and to induce warmer makeup air during heating processes and cooler makeup air during cooling processes.

Materials used for heat exchangers commonly include metal foils and sheets, plastic films, paper sheets, and the like. Good heat exchange is generally possible with these materials, but significant moisture exchange cannot easily be performed. Desiccants, or moisture adsorbing materials, are occasionally employed to transfer moisture. With this method, the desiccant merely holds the moisture. To effectively transfer moisture between gas streams, the desiccant must be relocated from the gas stream of higher moisture content to the gas stream of lower moisture content, requiring an additional input of mechanical energy. With many desiccant materials, satisfactory performance can be achieved only with the input of additional thermal energy to induce the desiccant to desorb the accumulated moisture.

Heat and moisture exchange are both possible with an exchange film made of paper. However, water absorbed by the paper from condensation, rain, or moisture present in the air can lead to corrosion, deformation, and mildew growth, and, hence, deterioration of the paper exchange film.

The various types of heat and moisture exchangers in common usage are generally contained within an opaque metal housing and located at or near the building air-handling units in the mechanical room, basement, or rooftop of the building. The nature of moisture exchange requires a very large surface area in contact with the gas stream, and, consequently, so-called total heat exchangers are often very large in size when compared to heat-only exchangers. A larger exchanger in the conventional locations requires additional mechanical room space and/or additional load-bearing capacity of the roof in the case of a roof-top unit.

Porous polymeric or ceramic films are capable of transferring both heat and moisture when interposed between air streams of differing energy and moisture states. A system for heat and moisture exchange employing a porous membrane is described in Japanese Laid-Open Patent Application No. 54-145048. A study of heat and moisture transfer through a porous membrane is given in Asaeda, M., L. D. Du, and K. Ikeda. "Experimental Studies of Dehumidification of Air by an Improved Ceramic Membrane," Journal of Chemical Engineering of Japan, 1986, Vol. 19, No. 3. A disadvantage of such porous composite film is that it also permits the exchange of substantial amounts of air between the gas streams, as well as particles, cigarette smoke, cooking odors, harmful fumes, and the like. With respect to building indoor air quality, this is undesirable. In order to prevent this contamination of make-up air, the pore volume of a porous film is preferably no more than about 15%, which is difficult and expensive to achieve uniformly. Furthermore, a porous film made to a thickness of 5 to 40 micrometers in order to improve heat exchange efficiency tears easily and is difficult to handle.

U.S. Pat. No. 6,178,966 to Breshears addressed the shortcomings described above by describing an improved apparatus for enabling heat and moisture exchange between makeup and exhaust air streams in the heating and air conditioning system of a structure. The apparatus included a rigid frame for holding a pair of light transmitting panes, the frame and panes collectively defining an interior cavity within the apparatus. The apparatus could be integrated into the exterior walls of a building. The light transmitting properties of the panes allow incident solar radiation to permeate the panels, creating a more natural ambient environment in the interior of the structure adjacent with the panel, as well as raising the temperature of the air stream and the water vapor permeable barrier to further enhance the exchange of moisture through the barrier.

In the prior art Breshears apparatus, a water-vapor-permeable barrier was provided within the apparatus, to divide the interior of the apparatus into sub-channels for receiving makeup and exhaust air streams, respectively. The barrier was described as a composite film made of porous polymeric membrane having applied thereto a water-vapor-permeable polymeric material so as to form a non-porous barrier to block the flow of air and other gas.

Despite overcoming some of the shortcomings of preexisting systems, the prior art Breshears apparatus was limited in some ways. For example, the disclosed apparatus was limited to transparent structures configured to be integrated into the exterior of a building. Furthermore, the polymeric membranes described by Breshears were limited to certain particular membrane materials.

DETAILED DESCRIPTION

The present teachings relate to improved methods and apparatus for recovering energy and/or moisture as air is added to and exhausted from an enclosed space. These teachings may be combined, optionally, with apparatus, methods, or components thereof described in U.S. Pat. No. 6,178,966 to Breshears. However, the present teachings expand upon the prior art teachings by disclosing novel improvements such as an exchanger incorporated into an opaque exterior building element. These and other aspects of the present teachings are described in detail in the sections below.

This description discusses some of the basic features of heat and moisture exchangers according to aspects of the present teachings, and focuses particularly on incorporating exchangers into various external building elements, such as walls, foundations, roofs, and slab floors configured to divide an enclosed space from the ambient exterior and collectively referred to as a building enclosure system. See FIGS. 1-10B.

Figure 1:
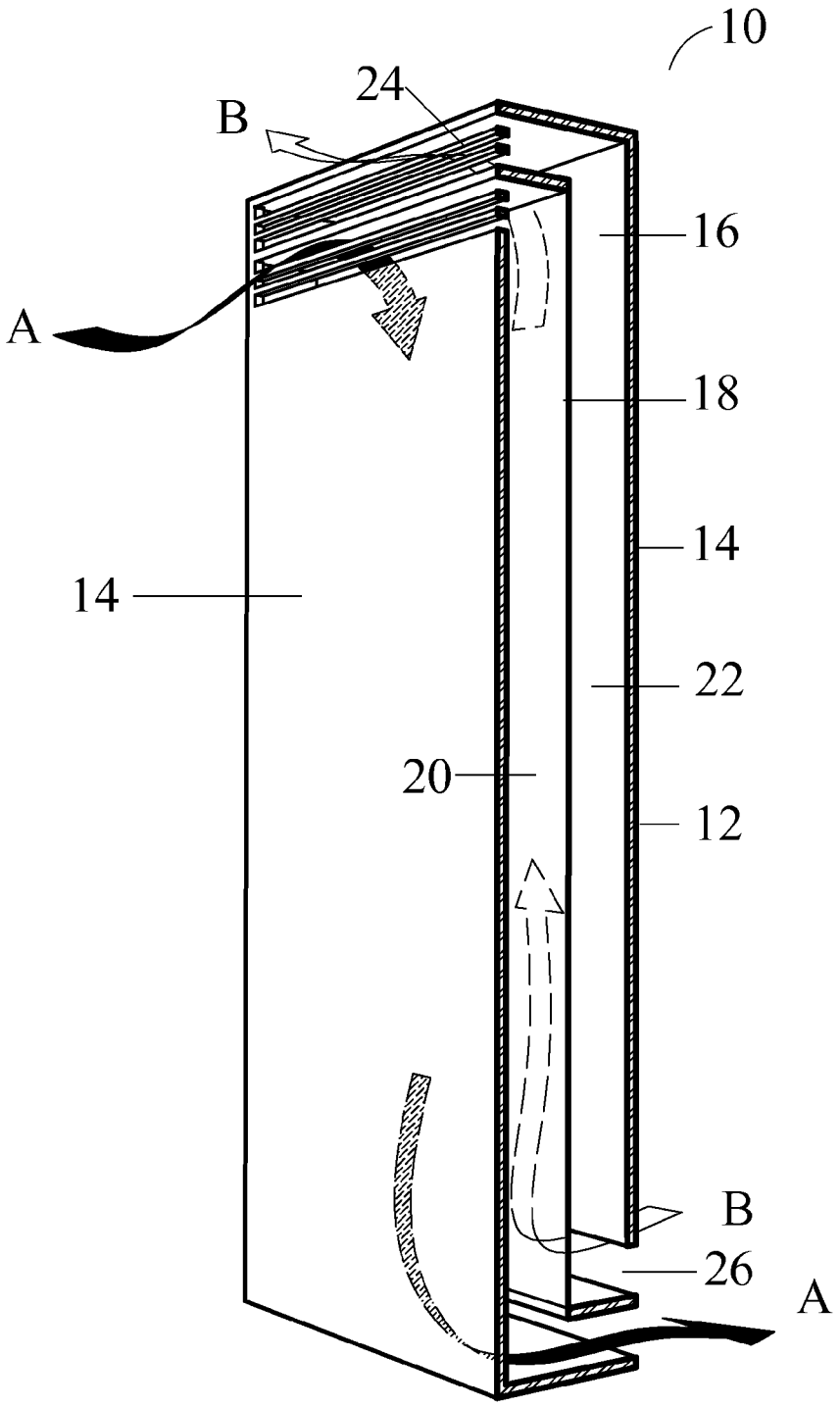
FIG. 1 is a perspective view depicting an embodiment of a heat and moisture exchanger ("exchanger") according to aspects of the present teachings.

FIG. 1 is a perspective view depicting an illustrative heat and moisture exchanger (which may be referred to herein as simply an "exchanger"), generally indicated at 10, according to aspects of the present teachings. Exchanger 10 is an apparatus for enabling heat and moisture exchange between air streams. An exchanger housing, generally indicated at 12, includes an exterior wall 14 defining an interior channel 16 through which a gas may pass. A barrier 18 is disposed within interior channel 16 and partitions interior channel 16 into sub-channels 20 and 22, each of which is adapted to receive a gas stream, such as a source air stream A and an exhaust air stream B, respectively. Channel 16, and thus sub-channels 20 and 22, may be in fluid communication with gas stream sources via suitably located openings in housing exterior wall 14 such as openings 24 and 26 shown in FIG. 1, which may in turn include louvers, screens, or other elements configured to direct flow and/or exclude foreign material.

In the embodiment of FIG. 1, exchanger housing 12, and in particular housing exterior wall 14, is configured to form a substantially opaque portion of a building enclosure system. Accordingly, exchanger housing 12 may be constructed from any suitable, substantially opaque material, such as steel, aluminum or other metal, acrylic, polycarbonate or other plastic, wood, composites, back-painted or non-transparent glass, or combinations thereof. Furthermore, the exchanger housing may be sized and proportioned such that it can be integrated into—and form a part of—a building enclosure. For example, the housing may include a structural frame and enclosing sheet material, and may be configured as a panel forming one or more elements of an overall panelized building enclosure system. As described in more detail below, the exchanger housing may be implemented as a portion of the building wall system, roof system, floor or foundation system, or other part of the building's exterior.

Barrier 18, which divides interior channel 16 into sub-channels 20 and 22, is generally permeable to water vapor and substantially impermeable to the constituent gases of air, which principally include nitrogen and oxygen. Various types of barriers may be suitable for use with the present teachings, including microporous polymeric membranes with appropriate characteristics. One particularly suitable type of polymeric membrane is described in U.S. Patent Publication No. 2007/0151447 to Merkel, which is hereby incorporated by reference into the present disclosure for all purposes.

In a manner described in more detail below, source and exhaust gas streams, respectively denoted throughout the drawings as gas stream A and gas stream B, are directed through adjacent sub-channels 20 and 22 within exchanger 10. Due to the proximity of the air streams, heat may be conducted from the hotter gas stream through barrier 18 and into the cooler gas stream, and moisture may be transported from the gas stream of higher moisture content through barrier 18 and into the gas stream of lower moisture content. Various barrier configurations and resulting geometries of sub-channels may be chosen depending on the desired heat transfer, moisture transfer, and pressure drop characteristics. The following paragraphs include descriptions of various such arrangements, with barriers and sub-channels that function in a manner similar to those described above.

Figure 2A:
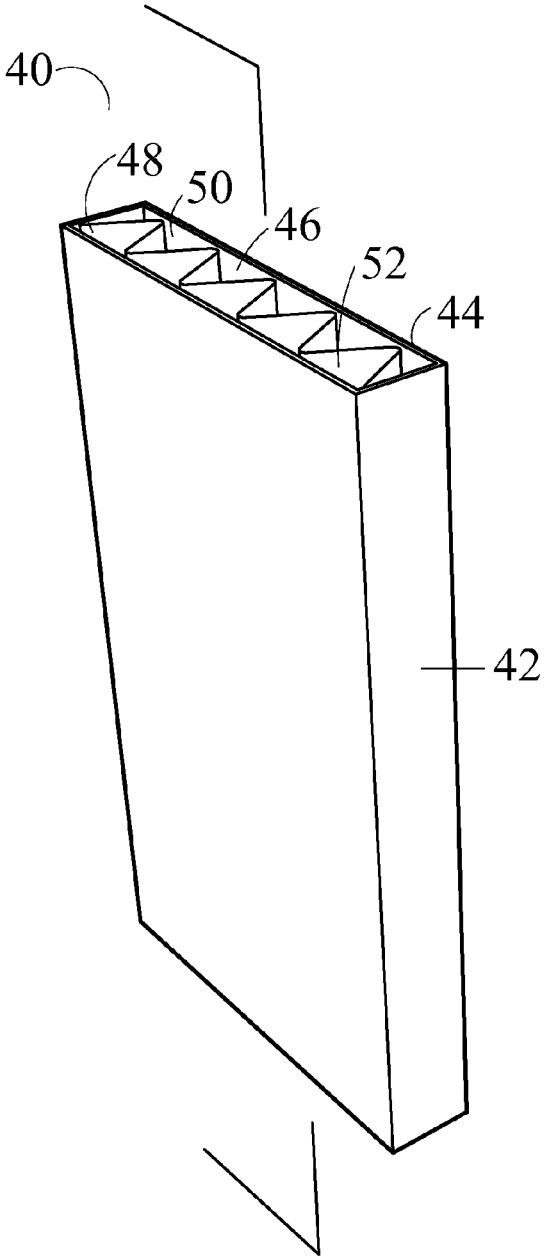
FIG. 2A is a perspective view of another embodiment of an exchanger according to aspects of the present teachings.
Figure 2B:
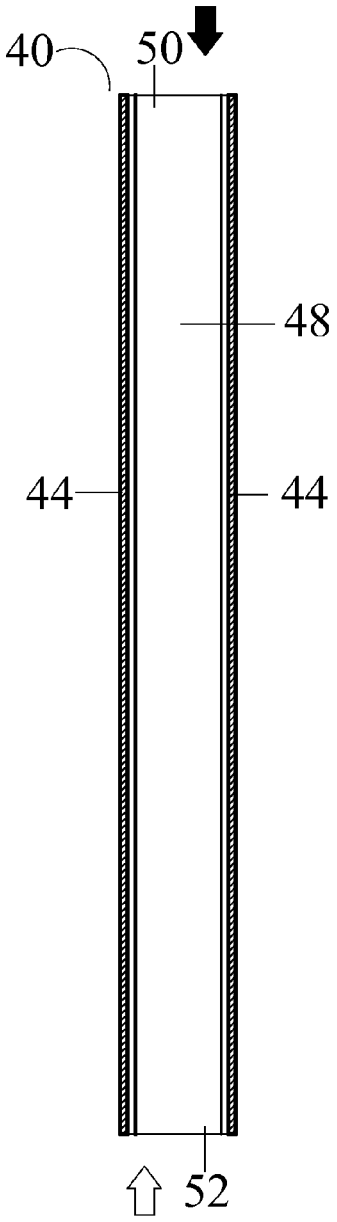
FIG. 2B is a sectional side view of a portion of the apparatus of FIG. 2A.

FIG. 2A depicts another illustrative embodiment of a heat and moisture exchanger, generally indicated at 40, according to aspects of the present teachings. Pleated-barrier exchanger 40 is similar to exchanger 10, including an exchanger housing 42 having a housing exterior wall 44 defining an interior channel 46 through which a gas may pass. A barrier 48 is disposed within interior channel 46. Unlike the barrier in exchanger 10, barrier 48 is formed in a corrugated or pleated fashion to allow a greater barrier surface area to fit into a given interior channel 46, with a corresponding increase in potential moisture and heat exchange. FIG. 2B, which is a sectional side view of the exchanger in FIG. 2A, shows that the folds of barrier 48 may not reach to the inner surface of housing exterior wall 44. Accordingly, a gap may remain on either side to allow fluid communication within each of two sub-channels 50 and 52 formed by the barrier. In other examples, the folds of barrier 48 may be configured to contact the inner wall surface of housing exterior wall 44, thus further subdividing sub-channels 50 and 52 into a plurality of smaller sub-channels having substantially triangular cross sections.

Figure 3A:
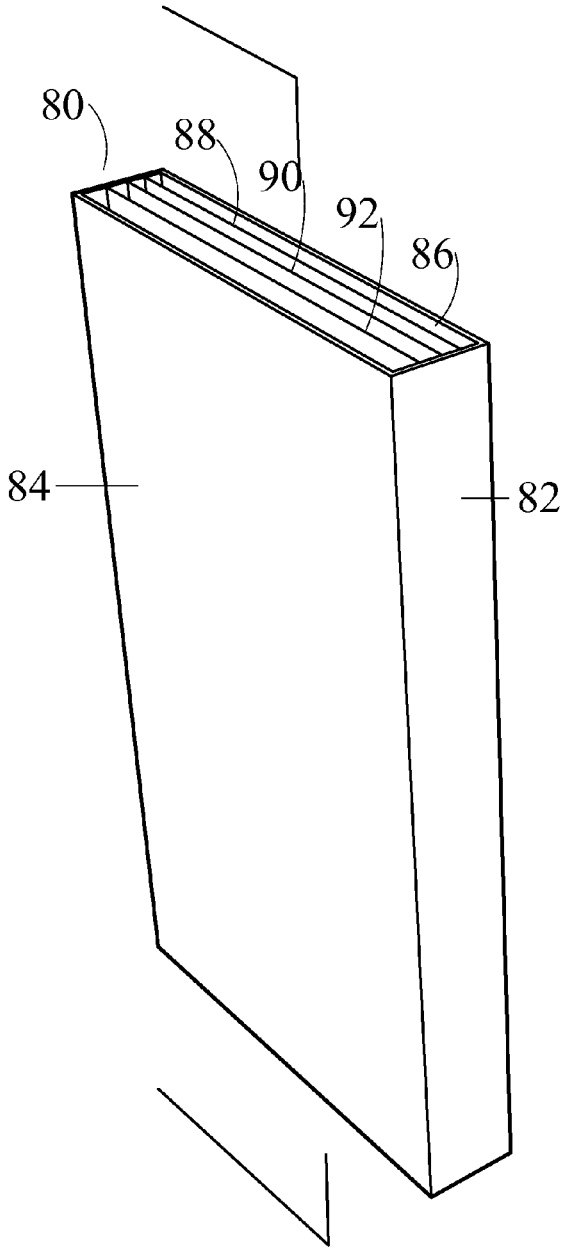
FIG. 3A is a perspective view of another embodiment of an exchanger according to aspects of the present teachings.
Figure 3B:
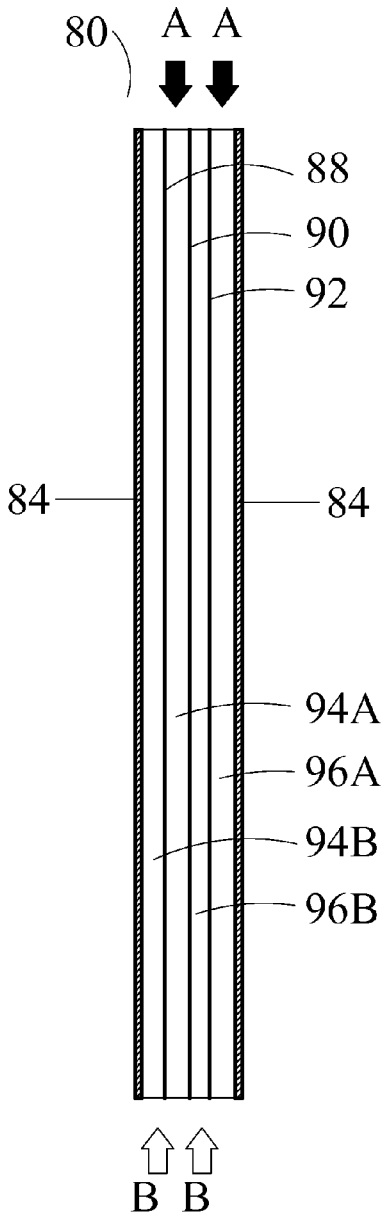
FIG. 3B is a sectional side view of a portion of the apparatus of FIG. 3A.

FIG. 3A depicts a perspective view of yet another illustrative embodiment of a heat and moisture exchanger, generally indicated at 80, according to aspects of the present teachings. Multi-barrier exchanger 80 is similar to exchanger 10, including an exchanger housing 82 having a housing exterior wall 84 defining an interior channel 86 through which a gas may pass. In this example, however, three barriers 88, 90, and 92 are disposed in channel 86, forming four sub-channels 94*a*, 96*a*, 94*b*, and 96*b*. In this example, gas stream A may flow through sub-channels 94*a* and 96*a*, while gas stream B may flow through sub-channels 94*b* and 96*b*. This flow pattern is more easily seen in the sectional side view shown in FIG. 3B.

Similar arrangements having odd numbers of barriers with corresponding even numbers of sub-channels are possible, such as disposing five barriers within channel 86 to form six sub-channels evenly divided between gas stream A and gas stream B. Alternatively, some examples may have any number of barriers forming any corresponding number of sub-channels, divided unevenly between gas streams A and B. For example, four barriers may be used to form five sub-channels, with three devoted to gas stream A and two to gas stream B. In yet other examples, the barrier arrangements of exchangers 40 and 80 may be combined to produce parallel pleated or corrugated barriers, or even alternating corrugated and flat barriers, in any case forming sub-channels with corresponding shapes.

FIGS. 4-7 depict illustrative exchangers, which may include features similar to those described above, integrated with various aspects of a building enclosure system. For simplicity, FIGS. 4-7 are depicted and described below as incorporating exchanger 10 of FIG. 1, but more generally, according to the present teachings any of the previously described exchangers or permutations thereof may be incorporated into aspects of a building enclosure system.

Figure 4:
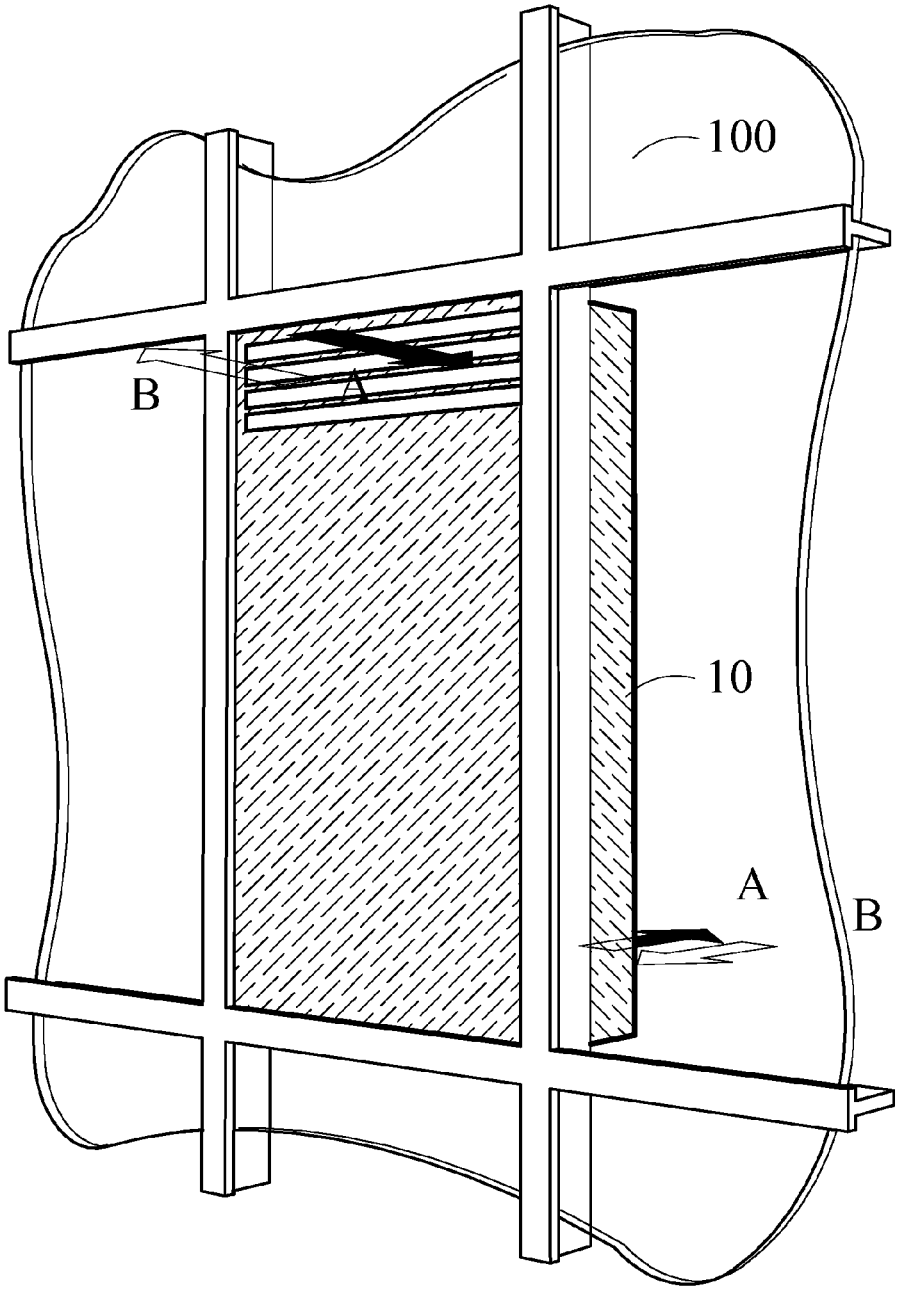
FIG. 4 is a perspective view of another embodiment of an exchanger integrated into an illustrative exterior building wall.

For example, FIG. 4 is a perspective view depicting an illustrative exchanger 10 integrated into a building exterior wall 100. As depicted in FIG. 4, a portion of housing exterior wall 14 may be configured to act as an exterior portion of the building enclosure system, and may be exposed to outdoor environmental conditions. Accordingly, at least a portion of housing exterior wall 14 may be constructed of weather-resistant material. Suitable materials for the housing exterior wall may include stainless steel; painted, coated, or anodized metal, plastic or wood with coatings or sealants applied to reject moisture and air penetration and retard degradation due to exposure to weather, or other weather-resistant and durable materials. In some examples, a portion of housing exterior wall 14 is exposed to outdoor environmental conditions while another portion of housing exterior wall 14 is exposed to a building interior. Exchanger 10 may thus form an exterior wall portion and/or an interior wall portion of the building enclosure system.

Figure 5:
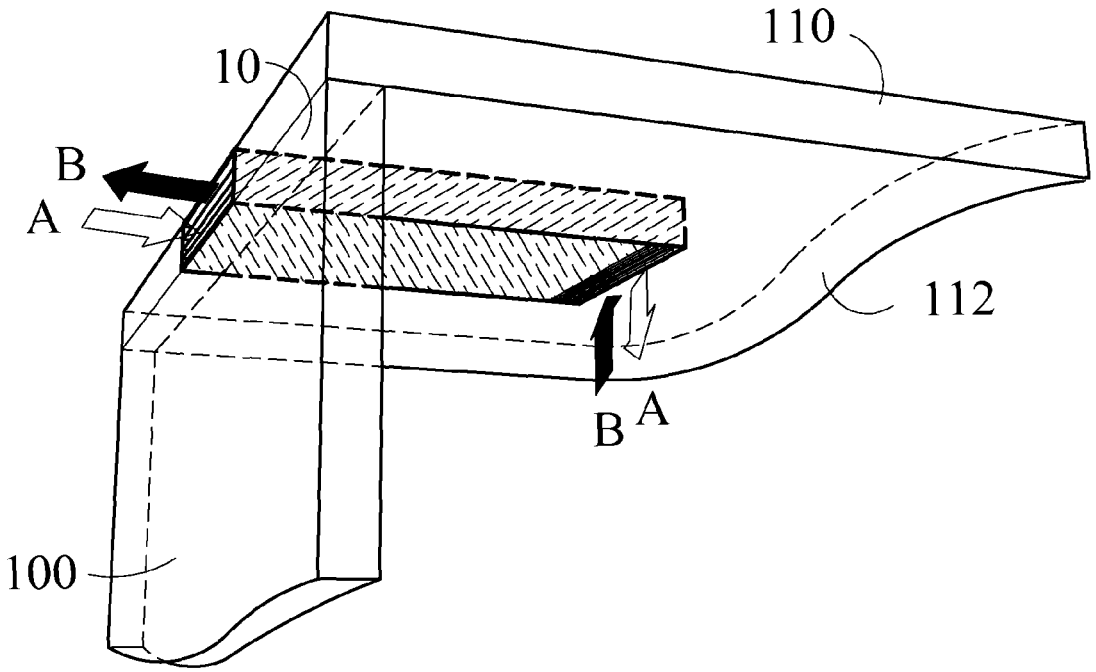
FIG. 5 is a perspective view of another embodiment of an exchanger integrated into an illustrative building roof.

FIG. 5 depicts an illustrative exchanger 10 integrated into a building roof 110. As with the exchanger integrated into wall 100, at least a portion of an exterior surface of housing exterior wall 14 may be configured to be weather resistant, and may act as a portion of roof 110. In the example of FIG. 5, gas streams A and B pass through suitable building exterior openings at the side edge of roof 110, and through suitable building interior openings disposed in a ceiling 112 beneath roof 110. Similar to wall integration, exchanger 10 may form an exterior portion and/or an interior ceiling portion of roof 110.

Figure 6:
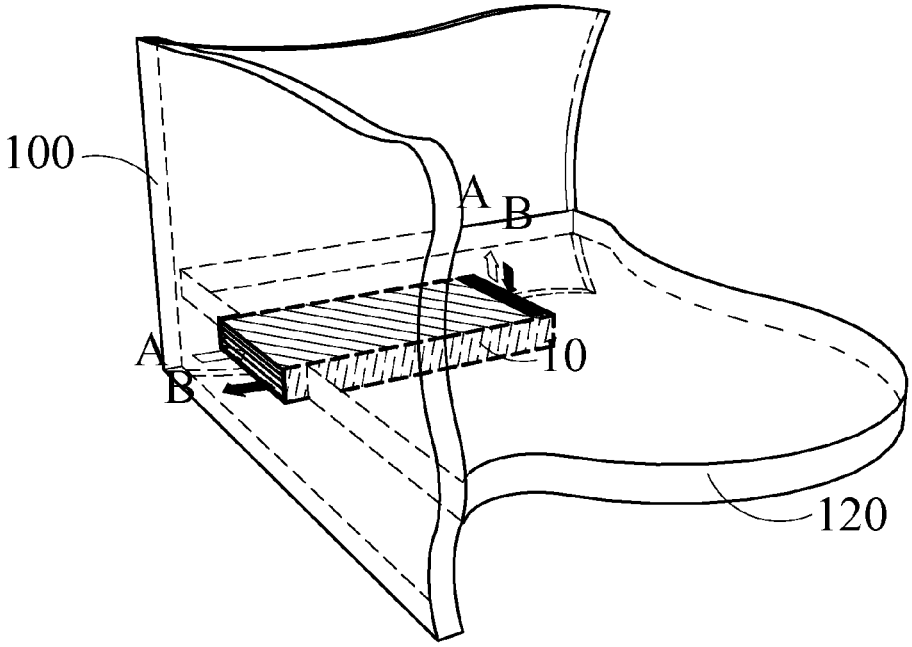
FIG. 6 is a perspective view of another embodiment of an exchanger integrated into an illustrative building floor.

FIG. 6 depicts a perspective view of another example of an exchanger 10, in this case integrated into an illustrative building floor 120. As depicted in FIG. 6, exchanger 10 may act as a portion of floor 120, with suitable openings for gas streams A and B at a building-interior surface of floor 120 and through an exterior wall 100. A portion of housing exterior wall 14 may be configured to act as a portion of floor 120.

Figure 7:
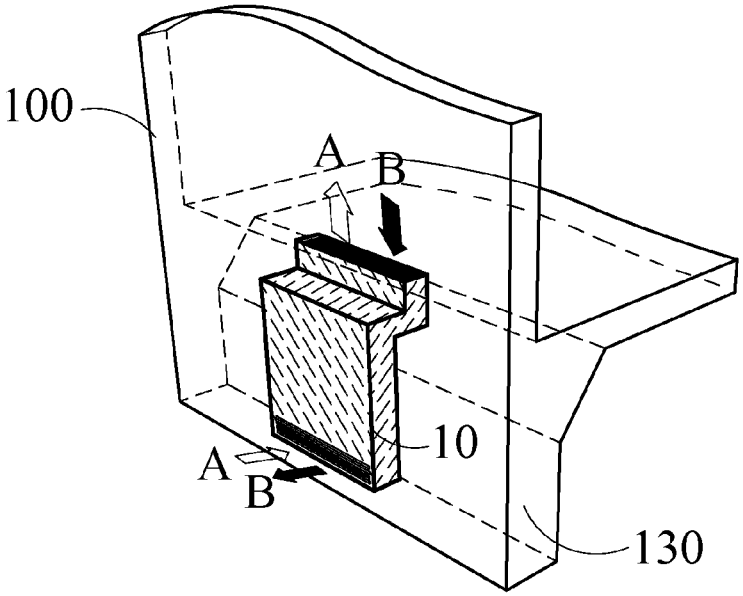
FIG. 7 is a perspective view of another embodiment of an exchanger integrated into an illustrative building foundation.

FIG. 7 depicts a perspective view of yet another example of an exchanger 10, here integrated into a building foundation 130. As depicted in FIG. 7, suitable openings in exchanger 10 configured to accommodate gas flows A and B may be disposed at an outer surface of building foundation 130 and at a building-interior floor. In this example, exchanger 10 may form a portion of the outer surface of foundation 130, and may be exposed to exterior environmental conditions. Accordingly, at least a portion of exchanger 10 may again be constructed of a weather-resistant material.

Figure 8:
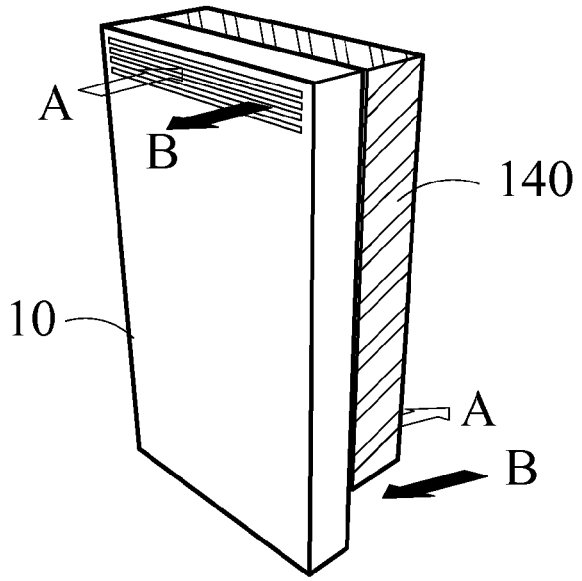
FIG. 8 is an isometric view of another embodiment of an exchanger showing an illustrative layer of insulation.
Figure 9:
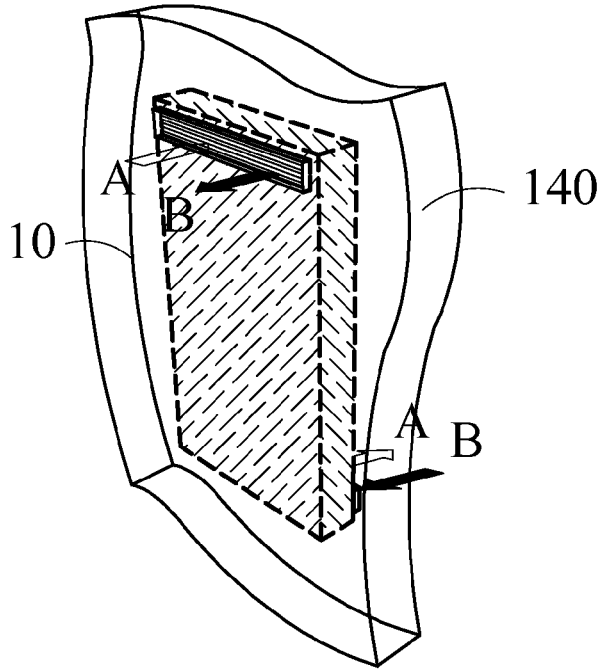
FIG. 9 is an isometric view of another embodiment of an exchanger showing another illustrative layer of insulation.

FIGS. 8 and 9 depict examples of exchanger systems including an insulation layer 140 that may be disposed adjacent to at least a portion of housing exterior wall 14. In FIG. 8, a single insulation layer 140 is shown adjacent to one side of exchanger 10. In FIG. 9, an alternative configuration is depicted, in which insulation layer 140 surrounds exchanger 10, with openings in layer 140 to allow unhindered passage of gas streams A and B. These insulation layer depictions are illustrative only. Many suitable thicknesses and dispositions of insulation adjacent to exchanger 10 are possible.

Figure 10A:
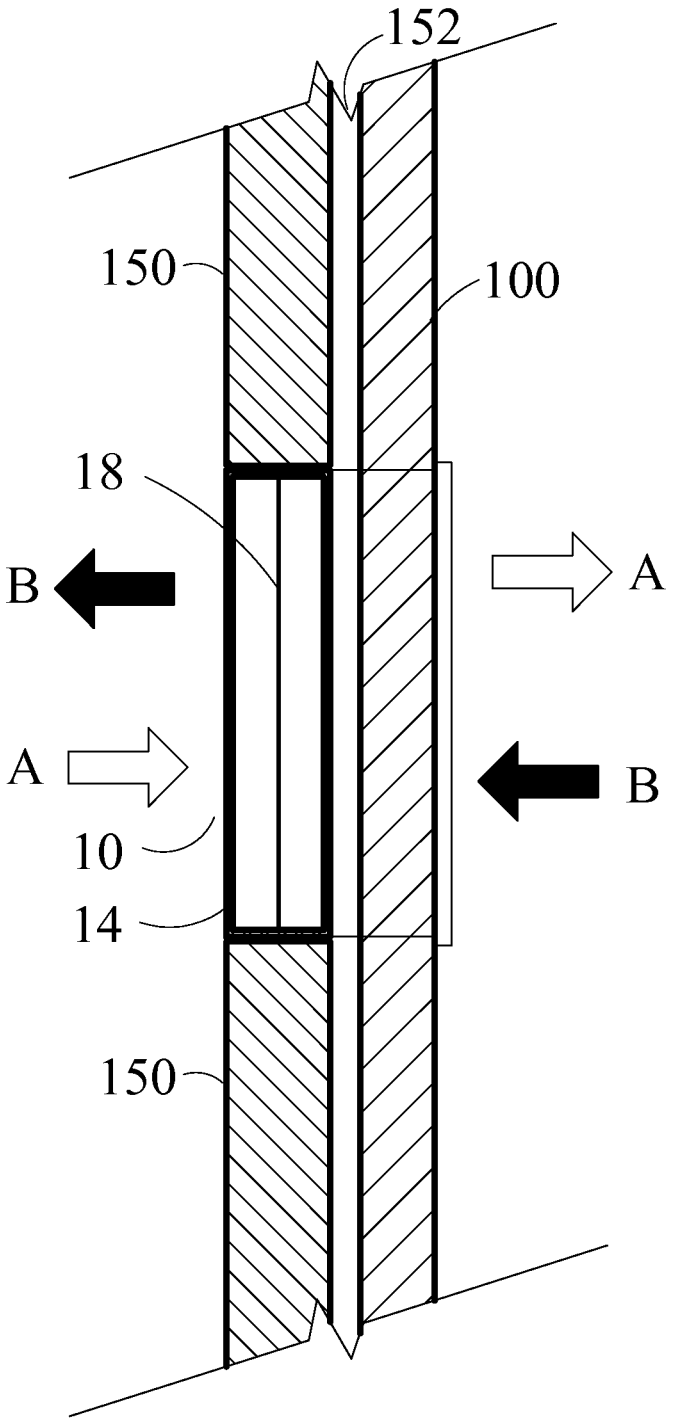
FIG. 10A is a sectional top view of another embodiment of an exchanger integrated into an illustrative weather-resistant wall layer.
Figure 10B:
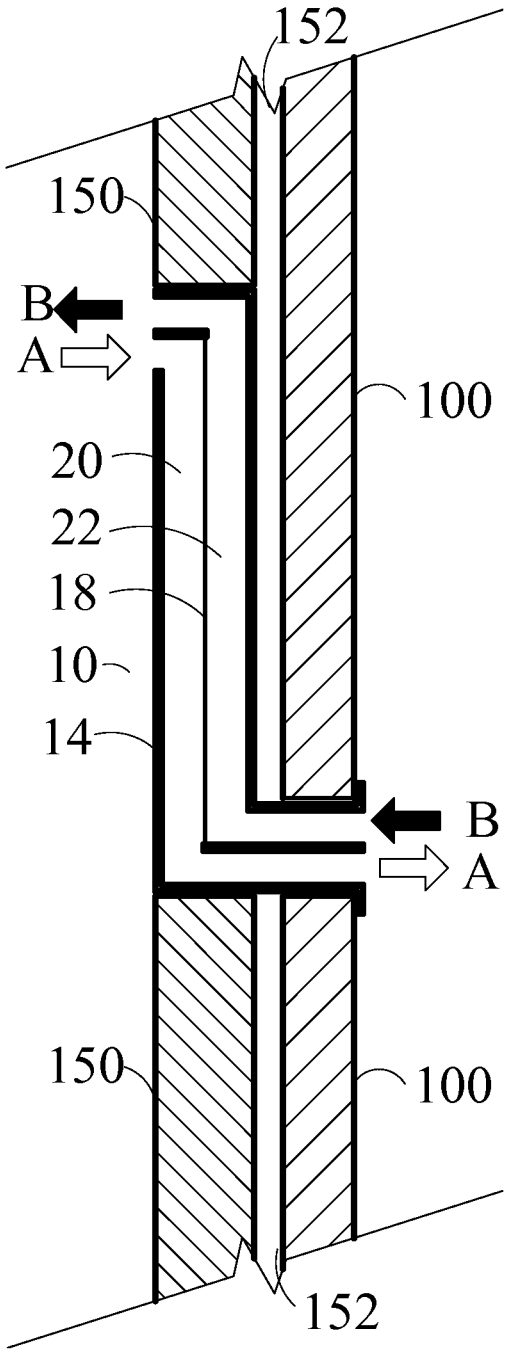
FIG. 10B is a sectional side view of the apparatus of FIG. 10A.

FIGS. 10A and 10B depict still another illustrative exchanger system, including an exchanger 10 integrated into a building exterior wall 100. In this example, exchanger 10 may be further integrated into a rain screen enclosure system. Specifically, rain screen layer 150 may be disposed on the exterior side of building exterior wall 100, and may furthermore leave an air gap 152 between layer 150 and wall 100. FIG. 10A is a top sectional view depicting an example of this sort of arrangement, showing that exchanger 10 may be configured to act as a portion of a rain screen layer 150. As best seen in the sectional side view of FIG. 10B, a portion of exchanger 10 may also pass through wall 100 to allow fluid communication between the external environment and the building interior for gas streams A and B. To act as a part of the rain screen enclosure system, an exposed portion of housing exterior wall 14 of exchanger 10 may be constructed of weather-resistant material. With layer 150, exchanger 10 may form a continuous layer configured to prevent ingress of water into a building.

Figure 11:
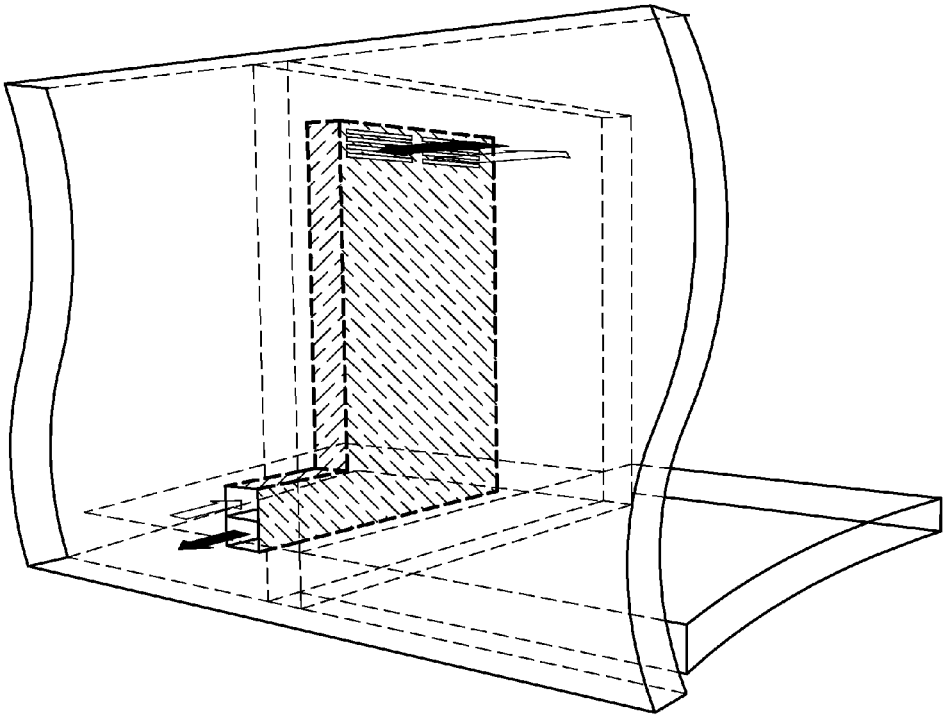
FIG. 11 is a perspective view of another embodiment of an exchanger integrated into an illustrative building interior wall.
Figure 12:
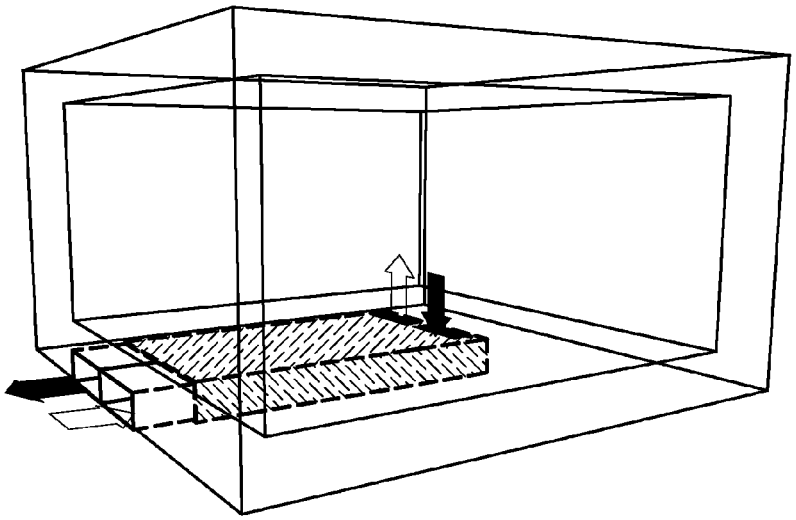
FIG. 12 is a perspective view of another embodiment of an exchanger integrated into an illustrative building intermediate floor system.
Figure 13:
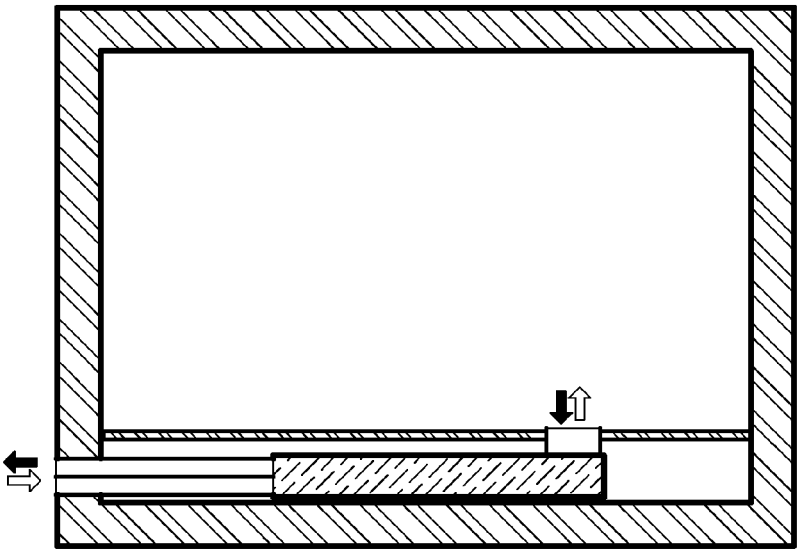
FIG. 13 is a sectional view of the exchanger of FIG. 12, showing the exchanger integrated into an illustrative building underfloor plenum.
Figure 14:
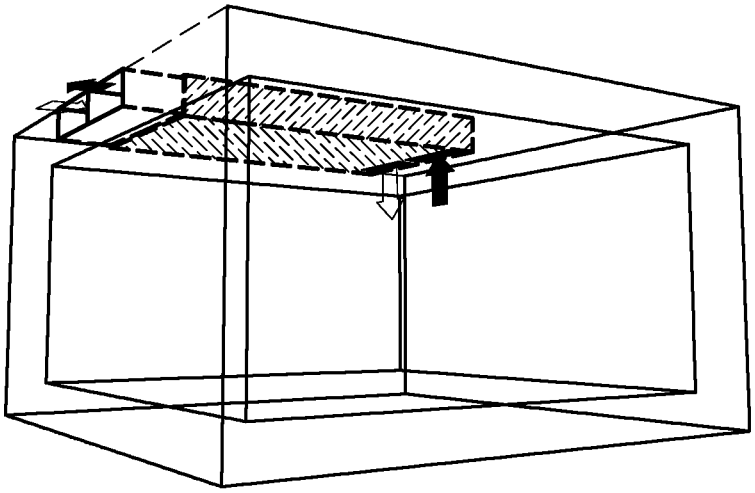
FIG. 14 is a perspective view of another embodiment of an exchanger integrated into an illustrative building intermediate ceiling system.
Figure 15:
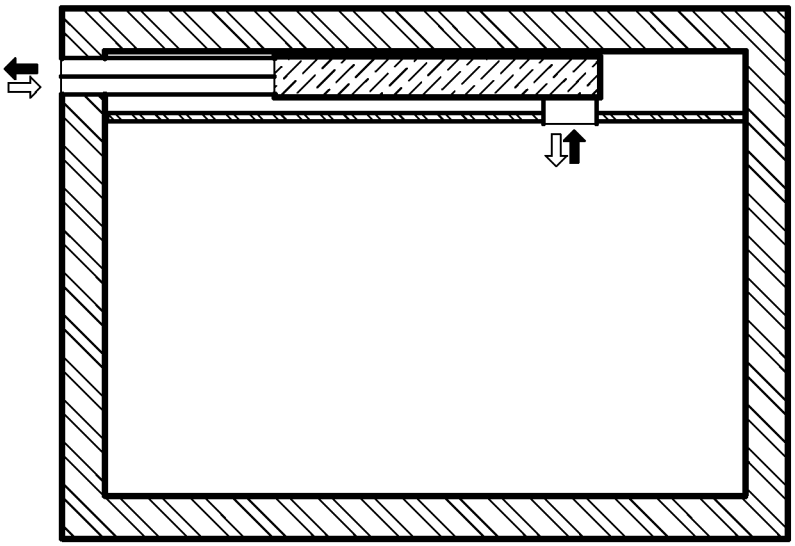
FIG. 15 is a sectional view of the exchanger of FIG. 14, showing the exchanger integrated into an illustrative building above-ceiling plenum.
Figure 16:
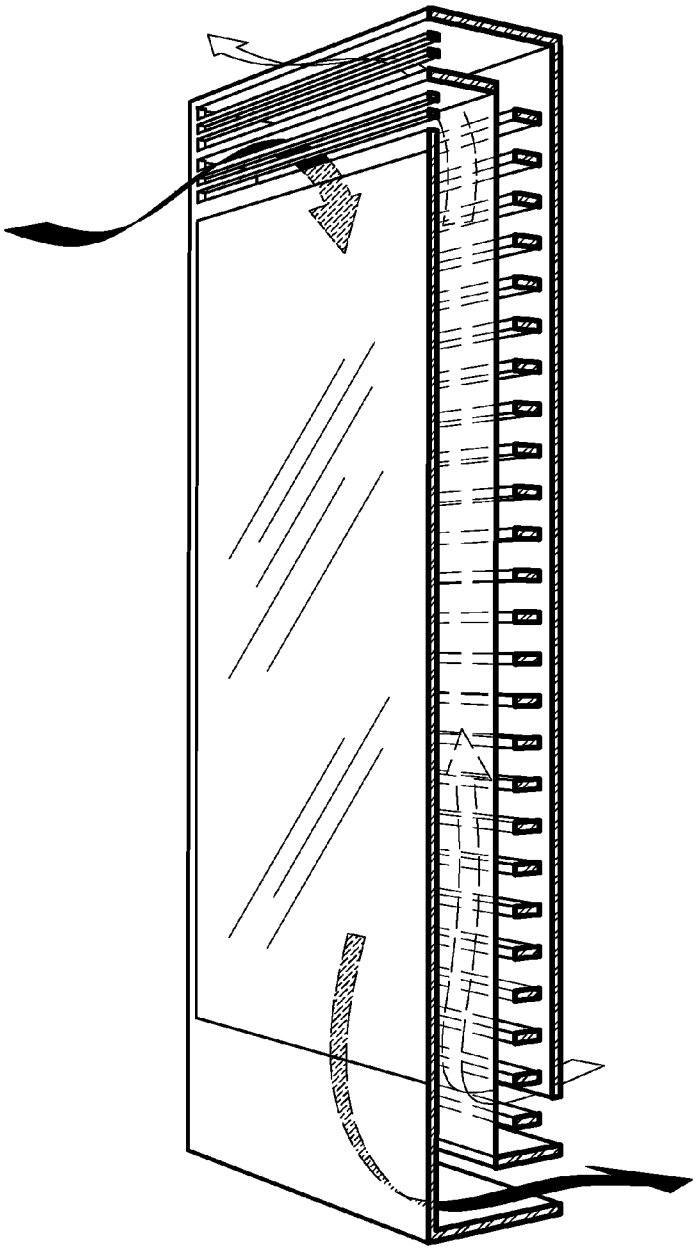
FIG. 16 is a perspective view of another embodiment of an exchanger, in which a portion of the exchanger is constructed from radiant energy transmitting enclosure material.
Figure 17:
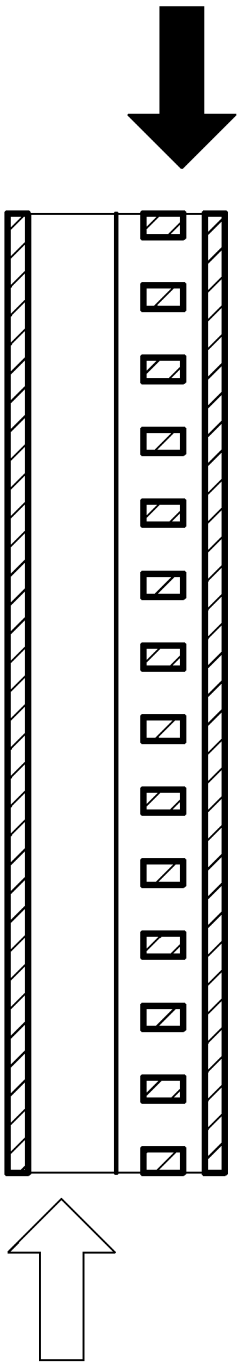
FIG. 17 is a sectional view of a portion of the exchanger of FIG. 16.
Figure 18:
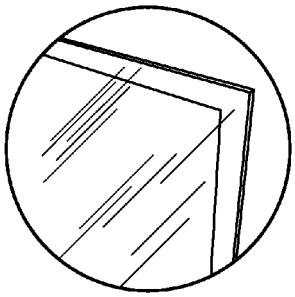
FIGS. 18-23 are magnified views of a portion of alternative embodiments of the exchanger of FIG. 16, depicting various types of radiant energy absorptive elements that may be disposed within the exchanger of FIG. 16.
Figure 19:
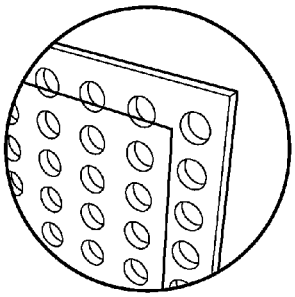
Figure 20:
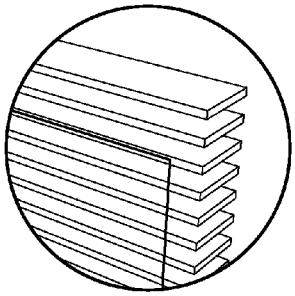
Figure 21:
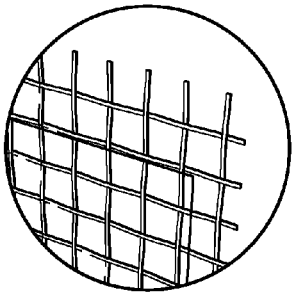
Figure 22:
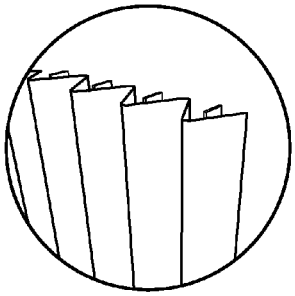
Figure 23:
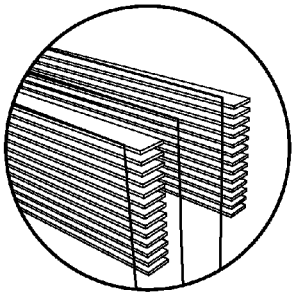
Figure 24:
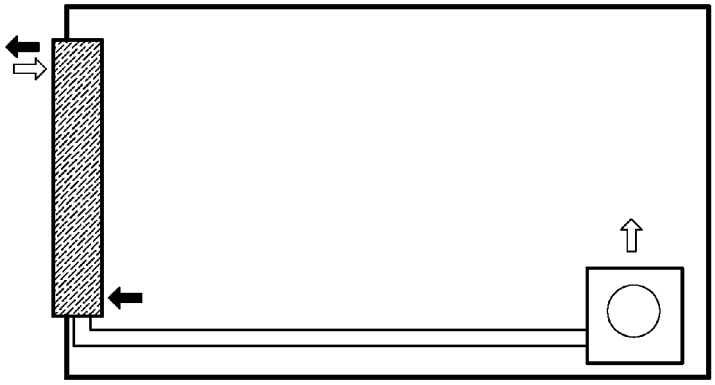
FIG. 24 is a schematic elevational view of an exchanger system, showing how an exchanger may be coupled with a mechanical cooling and ventilation apparatus through a dedicated fluid communication channel.
Figure 25:
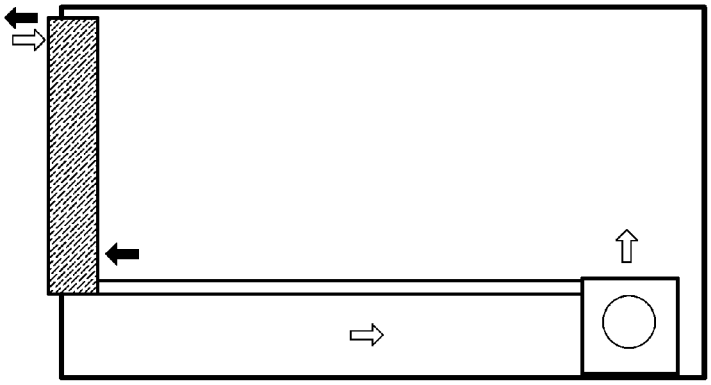
FIG. 25 is a schematic elevational view of another exchanger system, showing how an exchanger may be coupled with a mechanical cooling and ventilation apparatus through a building plenum space.
Figure 26:
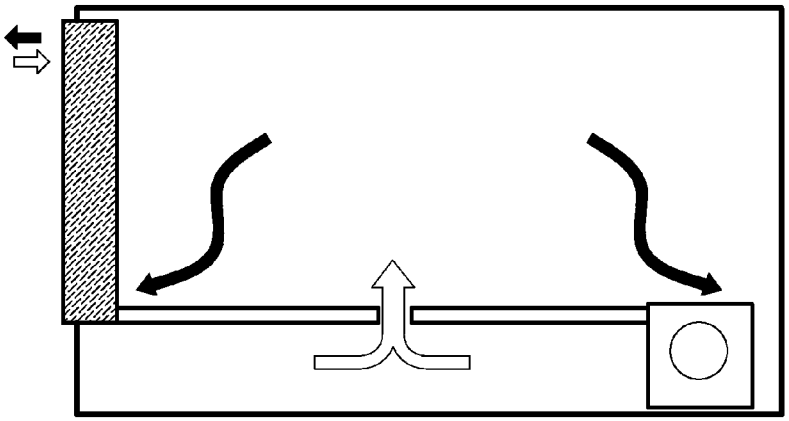
FIG. 26 is a schematic elevational view of still another exchanger system, showing another manner in which an exchanger may be coupled with a mechanical cooling and ventilation apparatus through a building plenum space.
Figure 27:
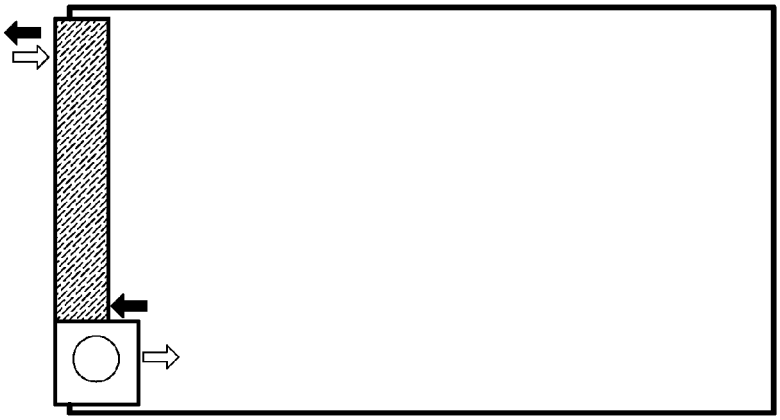
FIG. 27 is a schematic elevational view of yet another exchanger system, showing how an exchanger may be coupled directly with a mechanical cooling and ventilation apparatus.

FIGS. 11-27 depict various other embodiments and aspects of exchanger systems according to the present teachings. More specifically, FIG. 11 depicts how an exchanger may be integrated into a building interior wall; FIGS. 12-13 depict how an exchanger may be integrated into a building floor system; FIGS. 14-15 depict how an exchanger may be integrated into a building ceiling system; FIGS. 16-17 depict how an exchanger may be partially constructed from radiant energy transmitting enclosure material; FIGS. 18-23 depict how various types of radiant energy absorptive elements may be disposed within an exchanger to facilitate energy transfer and/or absorption; and FIGS. 24-27 depict various ways in which an exchanger may be coupled to a building's mechanical cooling and ventilation apparatus.

The disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. An apparatus for enabling heat and moisture exchange, comprising: an exchanger housing including an opaque front face, an opaque rear face parallel to the front face and a pair of opaque parallel side faces collectively defining an interior channel in the form of a shallow rectangular volume wherein the opaque front face and the opaque rear face each have a surface area greater than a surface area of either of the opaque side faces; and a barrier, permeable to water vapor and substantially impermeable to principal constituent gases of air, disposed within the interior channel, oriented generally parallel to the opaque front face and the opaque rear face, and partitioning the interior channel into first and second sub-channels adapted to receive a source air stream and an exhaust air stream, respectively; wherein the opaque front face forms an opaque first portion of a building enclosure system that is disposed outside of the interior channel, the opaque first portion being adjacent to, generally co-planar with, and facing in a common direction as a second portion of the building enclosure system that is not formed by the housing;

wherein the building enclosure system is panelized and the housing is configured as a panel element of the panelized enclosure system; and wherein the sub-channels are configured to direct the source air stream and the exhaust air stream parallel to the opaque front face and the opaque rear face within the sub-channels.

2. The apparatus of claim 1, wherein the opaque front face forms a portion of a wall of the building enclosure system.

3. The apparatus of claim 1, wherein the opaque front face forms a portion of a roof of the building enclosure system.

4. The apparatus of claim 1, wherein the opaque front face forms a portion of a floor of the building enclosure system.

5. The apparatus of claim 1, wherein the opaque front face forms a portion of a foundation of the building enclosure system.

6. The apparatus of claim 1, further comprising a layer of insulation disposed adjacent to the opaque front face.

7. The apparatus of claim 1, wherein at least a portion of the opaque front face is exposed to outdoor environmental conditions and wherein the exposed portion is constructed from a weather-resistant material.

8. The apparatus of claim 7, wherein the opaque front face is exposed to outdoor environmental conditions and the opaque rear face is exposed to a building interior.

9. The apparatus of claim 7, wherein the opaque front face forms a portion of an outermost layer of a rain screen enclosure system.

10. The apparatus of claim 9, further including a weather-resistant layer separate from the exchanger housing, wherein the opaque front face and the weather resistant layer form a continuous layer configured to prevent ingress of water into a building.

11. An apparatus for enabling heat and moisture exchange, comprising:

an opaque exchanger housing having an opaque front face, an opaque rear face and a pair of opaque side faces collectively defining an interior channel in the form of a shallow rectangular volume with the front and rear faces each having a respective surface area that is larger than a surface area of each of the side faces, and wherein the front face forms an opaque first part of a building enclosure system that is exterior of the interior channel and is adjacent to, generally co-planar with, and faces in a common direction as a second part of the building enclosure system that is not formed by the housing;

a corrugated membrane disposed within the housing generally parallel to the front face, and dividing the interior channel into a first sub-channel through which a source gas stream may pass and a second sub-channel through which an exhaust gas stream may simultaneously pass;

wherein the membrane is permeable to water vapor and substantially impermeable to principal constituent gases of air; and wherein the membrane is corrugated by an amount allowing a desired membrane surface area to fit within the interior channel;

wherein the building enclosure system is panelized and the housing is configured as a panel element of the panelized enclosure system; and wherein the sub-channels are configured to direct the source air stream and the exhaust air stream parallel to the opaque front face and the opaque rear face within the sub-channels.

12. The apparatus of claim 11, wherein the front face forms an interior wall portion of the building enclosure system.

13. The apparatus of claim 11, wherein the front face forms an exterior wall portion of the building enclosure system.

14. The apparatus of claim 13, wherein the front face is exposed to outdoor environmental conditions and is constructed from a weather-resistant material.

15. The apparatus of claim 11, wherein the front face forms an interior wall portion of the building enclosure system, and the rear face forms an exterior wall portion of the building enclosure system.

16. The apparatus of claim 11, wherein the front face forms a roof portion of the building enclosure system.

17. The apparatus of claim 11, wherein the front face forms a floor portion of the building enclosure system.

18. The apparatus of claim 11, wherein the front face forms a foundation portion of the building enclosure system.

19. A heat and moisture exchanger system, comprising: an exchanger housing having an opaque front face, an opaque rear face and a pair of opaque side faces, each side face having a surface area smaller than a surface area of the front face and the rear face so that the front, rear and side faces collectively define a shallow rectangular volume having a length, a width and a depth less than both the length and the width, wherein the front face forms an opaque first portion of a rain screen layer disposed on an exterior side of a building, the opaque first portion of the rain screen layer formed by the front face being adjacent to, co-planar with, and facing in a common direction as a second portion of the rain screen layer that is not formed by the exchanger housing; and a membrane dividing the rectangular volume defined by the exchanger housing into a pair of sub-channels each oriented substantially parallel to the front face and the rear face, the membrane configured to allow passage of water vapor and to prevent substantial passage of principal constituent gases of air between the sub-channels;

wherein the exchanger is configured (a) to allow passage of a source air stream from outside the building through one of the sub-channels to inside the building, (b) to allow passage of an exhaust air stream from inside the building through another of the sub-channels to outside the building, and (c) to transfer heat and moisture through the membrane between the exhaust air stream and the source air stream;

wherein the opaque rear face is disposed on the exterior side of the building, leaving an air gap between the opaque rear face and an exterior wall of the building, and wherein the sub-channels are configured to direct the source air stream and the exhaust air stream parallel to the opaque front face and the opaque rear face within the sub-channels.

20. The exchanger system of claim 19, wherein the front face is formed from a weather resistant material.

* * * * *